US007185741B1

(12) United States Patent
Rozenfeld

(10) Patent No.: US 7,185,741 B1
(45) Date of Patent: Mar. 6, 2007

(54) SYSTEM WITH MOVING ZERO STEP FOR STAIRS

(76) Inventor: Yakov Rozenfeld, 585 Newark Ave., apt. 10E, Elizabeth, NJ (US) 27208-3345

( * ) Notice: Subject to any disclaimer, the term of this patent is extended or adjusted under 35 U.S.C. 154(b) by 423 days.

(21) Appl. No.: 10/747,761

(22) Filed: Dec. 30, 2003

(51) Int. Cl.
*B66B 9/08* (2006.01)

(52) U.S. Cl. ..... 187/200; 187/201; 187/202

(58) Field of Classification Search ..... 187/200, 187/201; 482/52, 53; 198/331, 328
See application file for complete search history.

(56) References Cited

U.S. PATENT DOCUMENTS 2,677,451 A * 5/1954 Normandeau ..... 198/328
2,832,436 A * 4/1958 Roberts ..... 187/201
3,497,215 A * 2/1970 Harrison et al. ..... 482/53
4,411,352 A * 10/1983 Kettle ..... 198/328
4,438,830 A * 3/1984 Born ..... 187/201
5,050,708 A * 9/1991 Wood ..... 187/201
5,482,153 A * 1/1996 Abraham et al. ..... 198/322
6,679,353 B1 * 1/2004 Muranaka ..... 187/202
6,783,482 B2 * 8/2004 Oglesby et al. ..... 482/54
* cited by examiner

*Primary Examiner*—Kathy Matecki
*Assistant Examiner*—Terrell Matthews
(74) *Attorney, Agent, or Firm*—Micheal I Kroll

(57) ABSTRACT

The present invention discloses an electromechanical traversing step system for transporting elderly users 12, infirm and others between floors of a building. A single moveable step 14 ascends or descends on a set of tracks 16 secured to the wall of the stairway 18 or the staircase structure above the flight of stairs 20. Travel is initiated by the user 12 positioning themselves on the movable step 14, selecting the ascension 22 or descension 24 switch and then gripping the handrails. Motion of the step commences and continues when a pressure sensor 26 responds to a force on the step 14 and the omic resistance of the user 12 is detected by sensors 28 in each of the handrails. Ascending motion continues until the tread of the movable step 14 is flush with the upper floor 30. The movable step 14 automatically returns to the docked position 32 at the bottom 34 of the staircase 18 once the user 12 departs from the step to the upper floor 30. The movable staircase must return to the docked position 32 on the lower floor to provide a conventional staircase for traversing by foot. The movable step 14 may be returned to the upper floor 30 by pressing the step call-up switch 36, which overrides the handrail 28 and step pressure 26 sensors and allows the movable step 14 to ascend without the user holding the handrails.

9 Claims, 7 Drawing Sheets

SYSTEM WITH MOVING ZERO STEP FOR STAIRS

BACKGROUND OF THE INVENTION

1. Field of the Invention

The present invention relates generally to stairway lifts, and more specifically, to a moving step for stairs.

Many homes have multiple floors including a basement. Household members easily traverse a staircase many times a day. Stair lifts have been used for many years to carry a person, who has difficulty climbing up and down stairs on their own accord.

One of the many drawbacks of a stair lift system is that the devise monopolizes the stairway and limits the use of the stairway by other household members. Most of these systems have wide tracks reducing the usable width of the staircase. Stair lift carriages protrude into the upper and lower landing area making passage through these areas difficult. Another drawback is the device is very obvious and diminishes the decorative esthetics of the staircase and surrounding area.

The present invention proposes a discrete electromechanical traversing step system, which overcomes or alleviates the problems associated with known stair lifts.

2. Description of the Prior Art

Numerous stair lift devices have been provided in prior art. While these devices may be suitable for the particular purpose to which they address, they would not be as suitable for the purposes of the present invention as heretofore described

SUMMARY OF THE PRESENT INVENTION

The present invention discloses an electromechanical traversing step system for transporting elderly users, infirm and others between floors of a building. A single moveable step ascends or descends on a set of tracks secured to the wall of the stairway or the staircase structure above the flight of stairs. Travel is initiated by the user positioning themselves on the movable step, selecting the ascension or descension switch and then gripping the handrails. Motion of the step commences and continues when a pressure sensor responds to a force on the step and the omic resistance of the user is detected by sensors in each of the handrails. Ascending motion continues until the tread of the movable step is flush with the upper floor. The movable step automatically returns to the docked position at the bottom of the staircase once the user departs from the step to the upper floor. The movable staircase must return to the docked position on the lower floor to provide a conventional staircase for traversing by foot. The movable step may be returned to the upper floor by pressing the step call-up switch, which overrides the handrail and step pressure sensors and allows the movable step to ascend without the user holding the handrails.

A primary object of the present invention is to provide a moving zero step for stairs comprising a ridged independent step, track members, a mechanical drive system and an electrical control system.

Another object of the present invention is to provide a step member mounted and controllably movable on the track members. Caster wheels on the step are retained in the track members.

Yet another object of the present invention is to move the step on the track members. Cables fastened to the step and a common shaft control the location and movement of the traversing step on the track members. The common shaft is driven by a plurality of sprockets and chains on the electric motor and common shaft.

In a preferred embodiment the drive system is located under the first and second step of the staircase. In other embodiments the drive system is contained in the movable step.

Still yet another object of the present invention is to provide an electrical control circuit compromised of switches for user input and sensors for automatic control of the present invention.

A further object of the present invention is to provide a docking location for the movable step such that the tread of the movable step and the bottom step of the staircase are flush.

A yet further object of the invention is to provide a conventional staircase for walking up and down the stairs when the movable step is in the docked position.

A still yet further object of the present invention provides means to secure a basket on the moveable step to transport items with or without the operator on the step.

An additional object of the invention provides means to decoratively match the movable step to the existing staircase.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
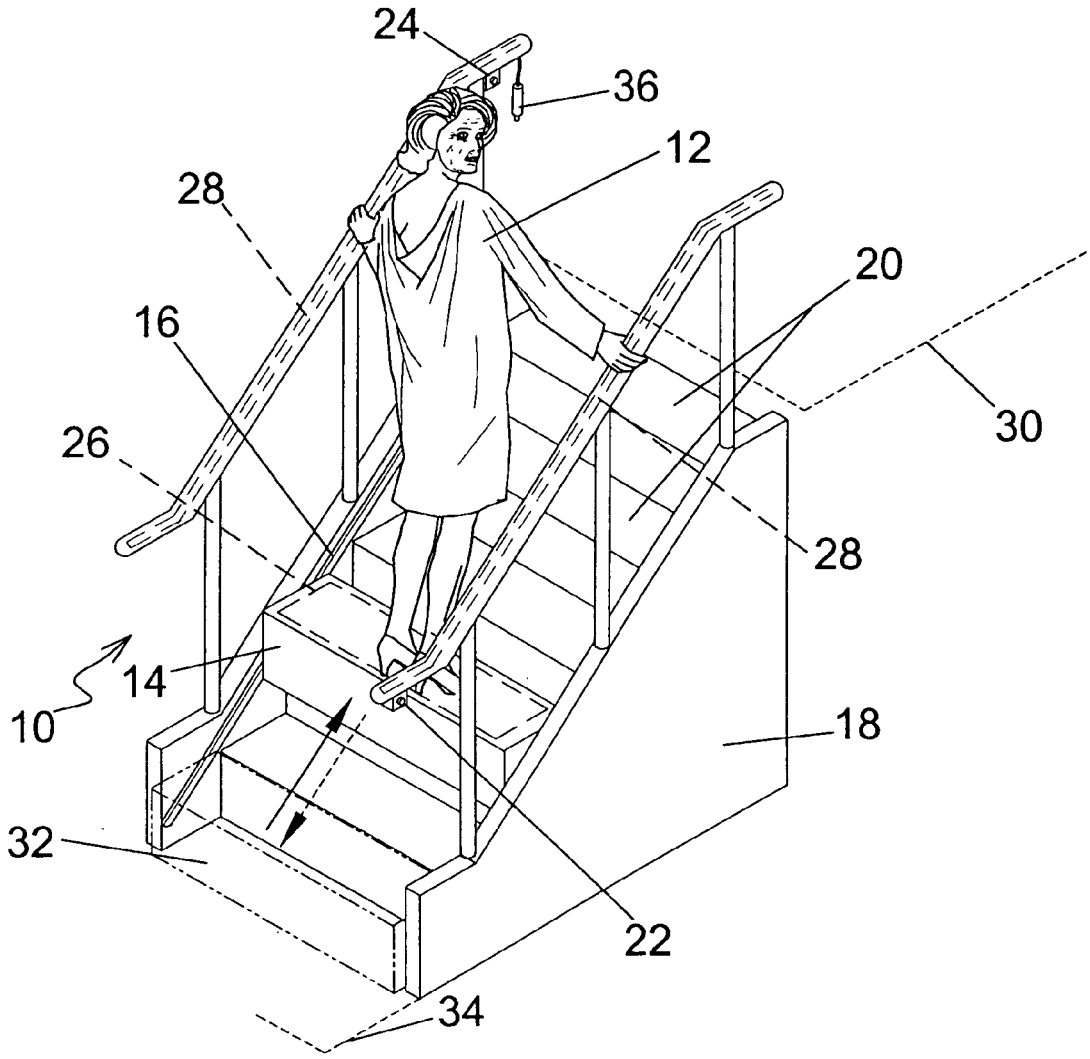
FIG. 1 an illustrative view of the present invention in use.

With regard to reference numerals used, the following numbering is used throughout the drawings.

10 present invention

12 user

14 movable stop

16 track

18 stairway
20 stairs
22 ascension switch
24 descension switch
26 pressure sensor
28 handrail sensor
30 upper floor
32 docked position
34 bottom
36 step call-up switch
38 first step
40 motor
42 power source
44 gear
46 shaft
48 sprockets
50 chains
52 bearings
53 bearing support
54 steel cable
56 cable spool
58 casters
60 pulleys
62 cable connection
66 stringer/frame
67 electronic sensor device
68 DC amplifier
70 electronic relay
72 electric device
74 contactor
76 contactor
78 contactor
80 arrow
82 upper stop sensor
84 lower stop sensor

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is an electromechanical traversing step system for transporting elderly users 12, infirm and others between levels or floors of a building. A single moveable step 14 ascends or descends on a set of tracks 16 secured to the wall of the stairway 18 or the staircase structure above the flight of stairs 20. Travel is initiated by the user 12 positioning themselves on the movable step 14, selecting the ascension 22 or descension 24 switch and then gripping the handrails. Motion of the step commences and continues when a pressure sensor 26 responds to a force on the step 14 and the omic resistance of the user 12 is detected by sensors 28 in each of the handrails. Ascending motion continues until the tread of the movable step 14 is flush with the upper floor 30. The movable step 14 automatically returns to the docked position 32 at the bottom 34 of the staircase 18 once the user 12 departs from the step to the upper floor 30. The movable staircase must return to the docked position 32 on the lower floor to provide a conventional staircase for traversing by foot. The movable step 14 may be returned to the upper floor 30 by pressing the step call-up switch 36, which overrides the handrail 28 and step pressure 26 sensors and allows the movable step 14 to ascend without the user holding the handrails.

Figure 2:
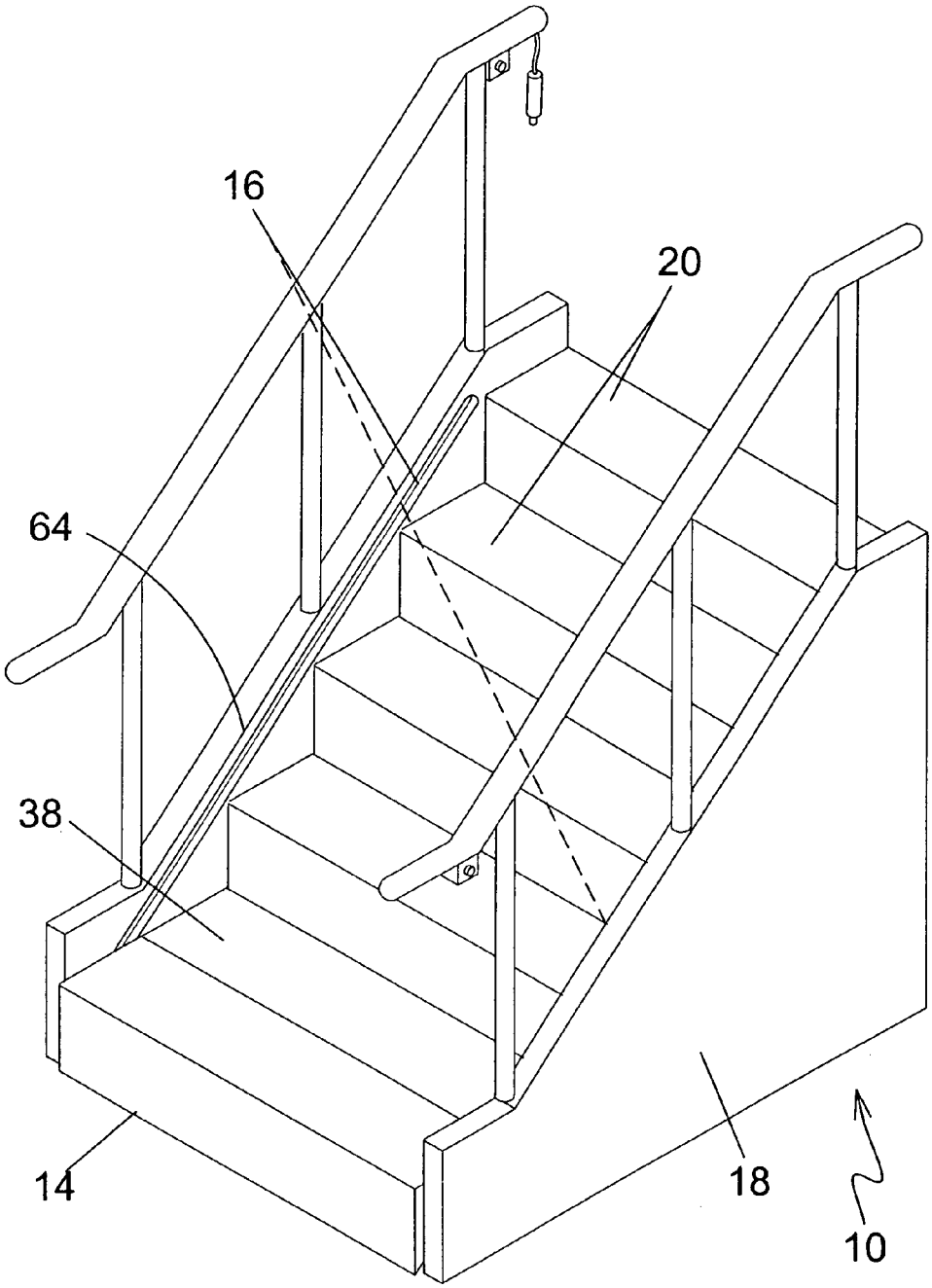
FIG. 2 is an illustrative view of the present invention.

Turning to FIG. 2, shown therein is an illustrative view of the present invention 10 showing the movable step 14 in the docked position flush with the first step 38 of stairway 18. The movable step 14 may be decorated to be identical to the stairs 20 and the tracks 16 recessed within the frame or stringers 64 to maintain a low profile and blend in with the surrounding area conditions.

Figure 3:
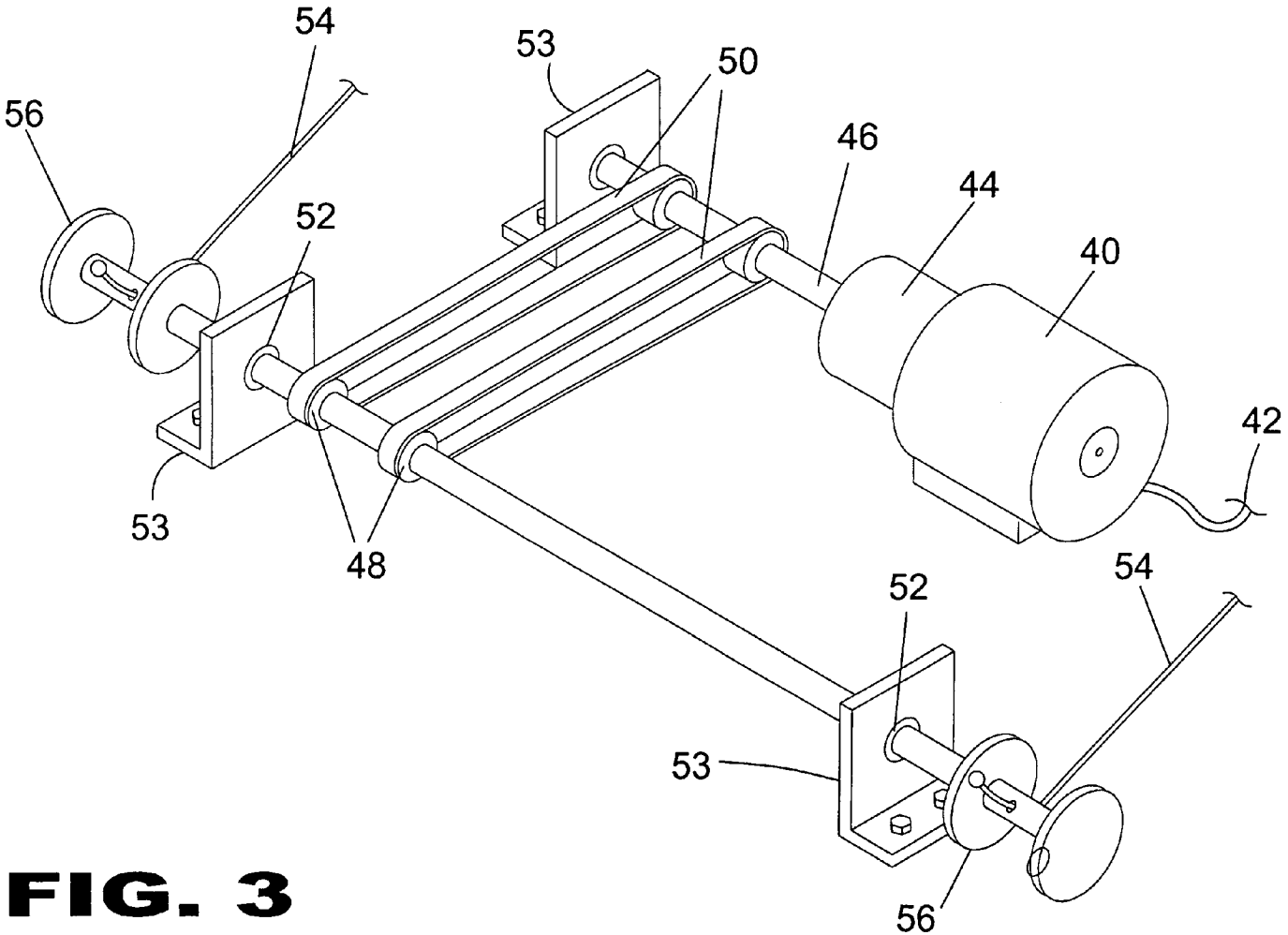
FIG. 3 is a perspective view of the drive system of the present invention.

Turning to FIG. 3, shown therein is a perspective view of the drive system of the present invention. The reversible motor 40 with power source 42 turns accordingly in response to electrical switches and relays (not shown but see FIG. 6). The motor 40 and related drive system shown is installed under the first and second steps of the stairs in new installations but the present invention may also be adapted to be retrofit to existing stairs utilizing a compact unit residing within the movable step. Shown are gear 44, gear spindle or shaft 46, sprockets 48, chains 50, bearings 52 and bearing supports 53, steel cable 54 and cable spool 56.

Figure 4:
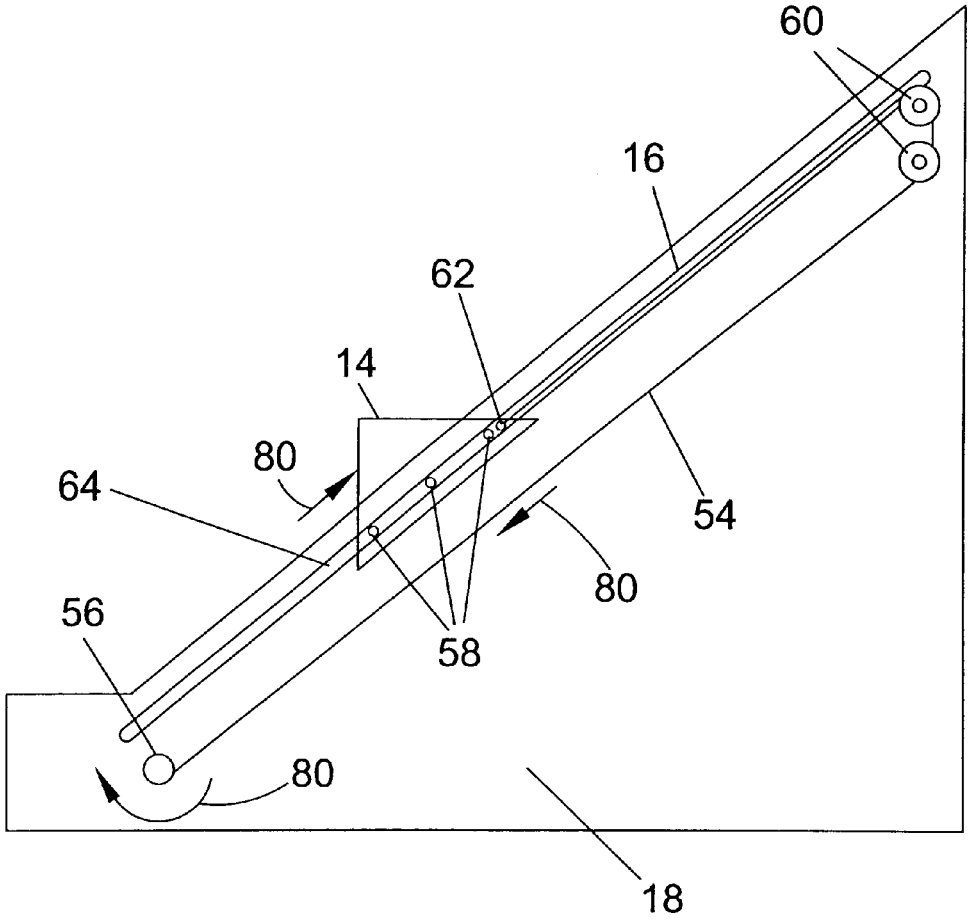
FIG. 4 is a side view of the cable set-up of the present invention.

Turning to FIG. 4, shown therein is a side view of the cable set-up of the present invention. The steel cable 54 is attached to the cable spool 56, which is rotated in response to the motor. The movable step 14 elevates as shown by arrow 80 as the cable 54 is wound onto the spool 56 and the casters 58 roll within the track 16. Also shown are pulleys 60, cable connection 62, stairway 18 and stringer or frame 64.

Figure 5:
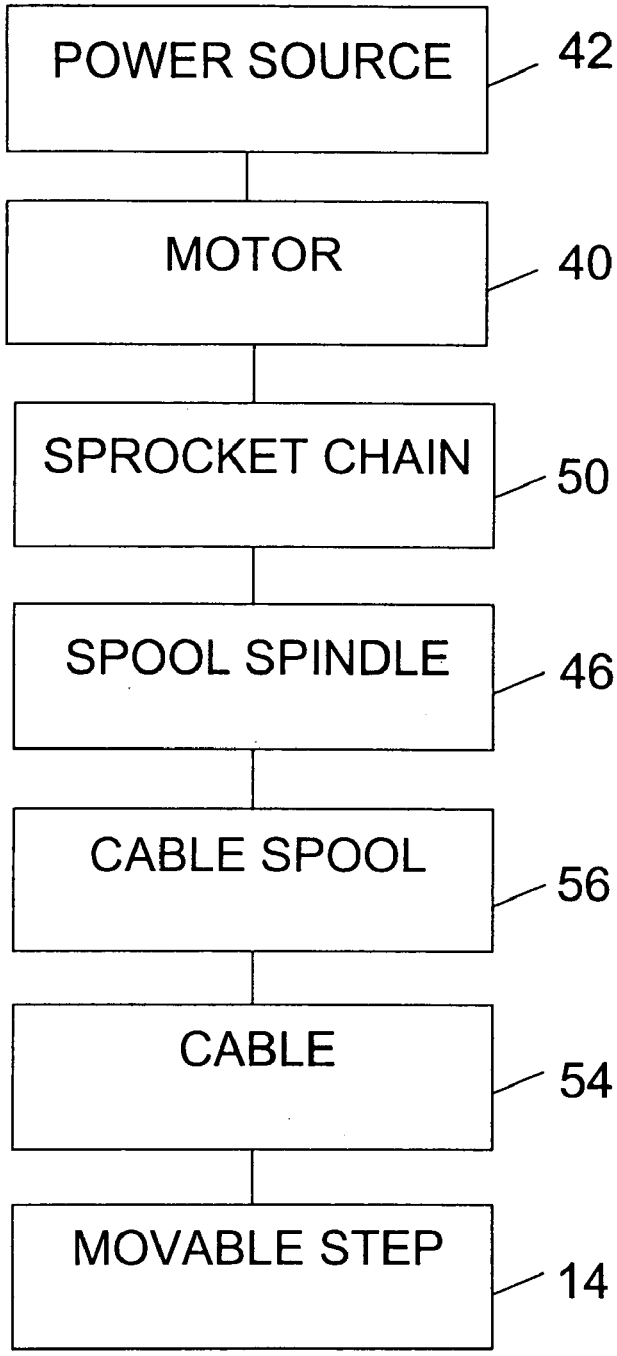
FIG. 5 is a block diagram of the drive system of the present invention.

Turning to FIG. 5, shown therein is a block diagram of the drive system of the present invention. The steel cable 54 winds around the cable spool 56 as the movable step 14 is rising and unwinds during its ascent. Also shown are the power source 42, motor 40, shaft 46 and chain 50.

Figure 6:
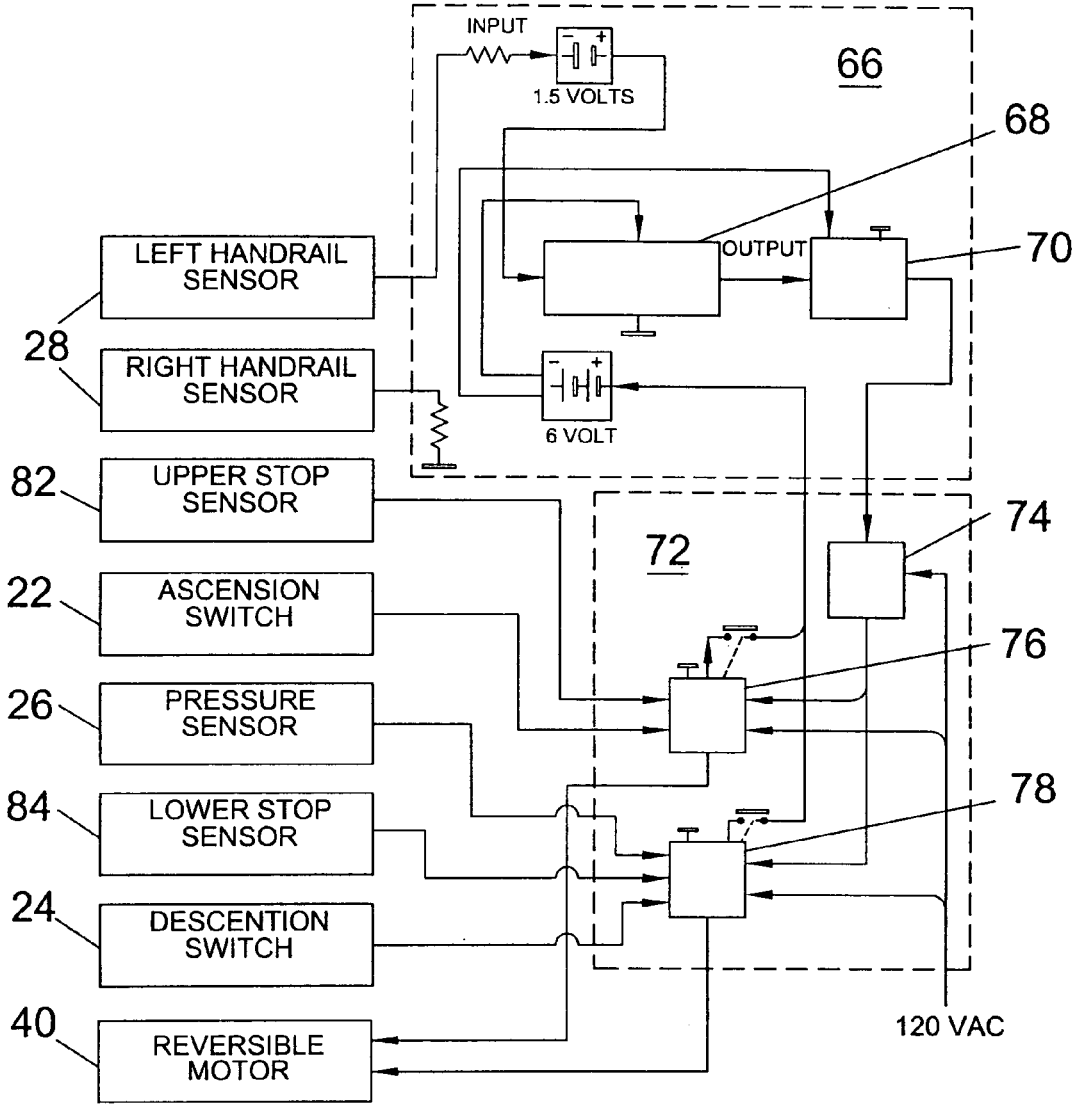
FIG. 6 is schematic diagrams of the electrical system of the present invention.

Turning to FIG. 6, shown therein is schematic diagrams of the electrical system of the present invention. Shown are the various electrical and electronic components of the present invention using electro/mechanical relays to govern the operation thereof. The present invention may also use other appropriate devices, such as a microcontroller or microprocessor, that achieve the objectives of the switching system as shown. Shown are left and right handrail sensors 28, upper 82 and lower 84 stop sensors, ascension 22 and descension 24 switches, pressure sensor 26, reversible motor 40; an electronic sensor device 66 containing DC amplifier 68 and electronic relay 70; and, an electric device 72 containing electric contactors for the motors for the handrails 74, ascending switch 76 and descending switch 78.

Figure 7:
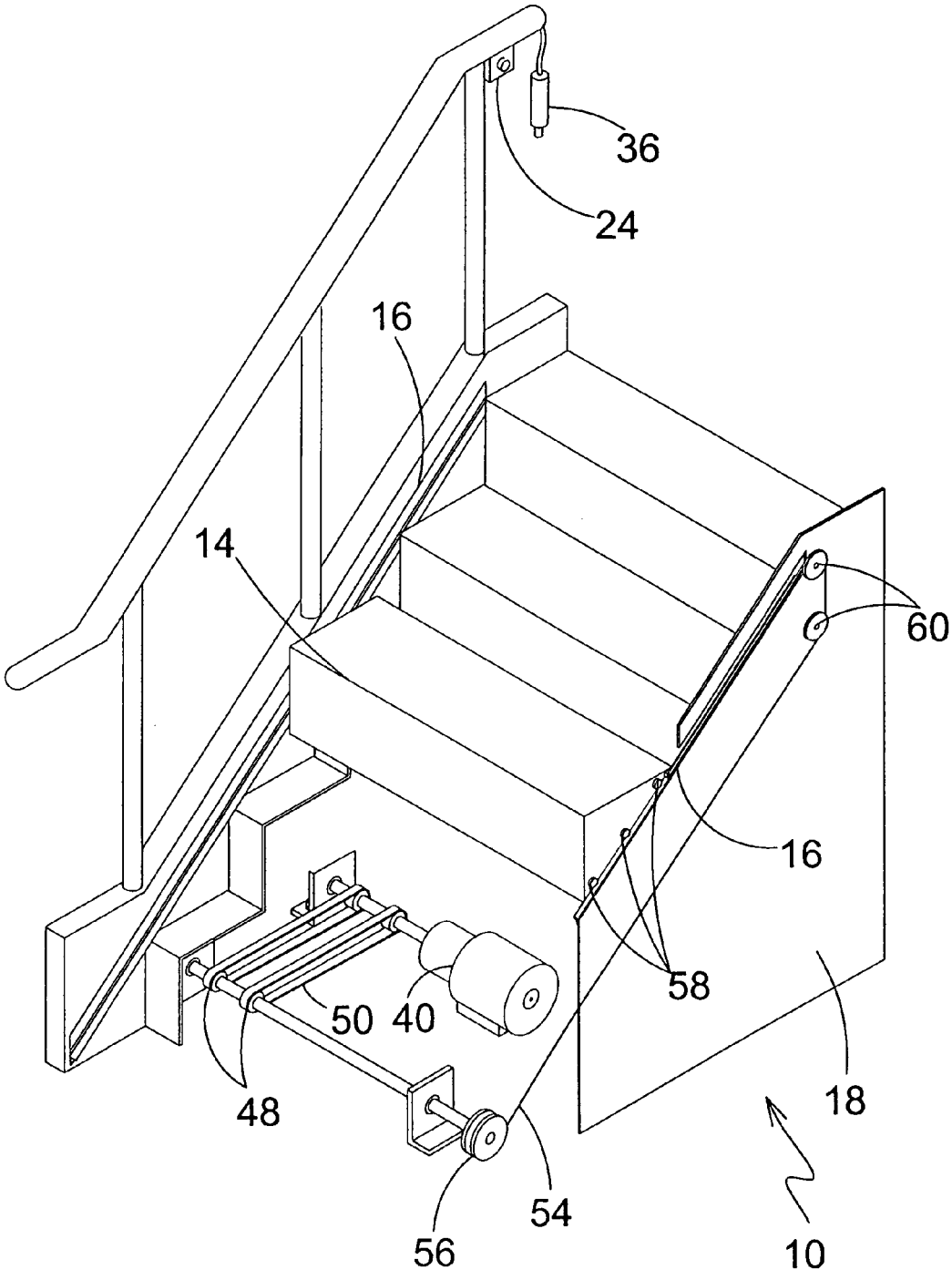
FIG. 7 is a sectional view of the present invention with the drive system under the staircase.

Turning to FIG. 7, shown therein is a sectional view of the present invention 10 with the drive system under the staircase 18. Shown are previously disclosed elements.

I claim:

1. A system for providing a moving step for stairs, comprising:

a) a stairway comprising a plurality of stairs from a lower level to an upper level, said stairs having a first step having a top surface above the elevation of said lower level, said stairs having a top step hang a top surface wherein said top surface of said top step is disposed contiguous with and at the same elevation of said upper level, said first step being disposed at the front of said stairway, and, a handrail disposed on first and second sides of said stairway;

b) a movable step having a vertical riser and a top surface and a first and second end, said movable step having clear surfaces without any parts thereof which are separately adjustable, said movable step extending the full width of said stairway and being disposed on said lower level in a first position in front of said first step so that said top surface of said movable step is at the same elevation as said top surface of said first step, said movable step in the first position being flush with the first step for maintaining a low profile blending in with surrounding conditions and wherein said movable step is movable to a second position so that said top surface of said movable step is at the same elevation as said top surface of said top step;

c) means for moving said movable step whereby the movable step is moved from said first position to said second position;

d) means for controlling said movable step whereby the operation of the movable step as it moves back and forth between the first position and the second position is controlled by a user; and e) said controlling means including an auto return switch for automatically returning said movable step from said second position to said first position upon a user departing said movable step at said second position at the upper level, said movable step appearing as a stationary step of said stairway when said movable step is not in use.

2. The system of claim 1, wherein said means for moving said movable step, comprises:

a) a stringer with a flat wall surface facing said stairs being disposed on said first and second side of said stairway, a track being disposed in said stringer, said stringer being elongated and extending from said lower level to said upper level; and, b) a plurality of casters disposed on each of said first and second ends of said movable steps, wherein said casters travel in said tracks so as to allow said movable step to move from said first position to said second position.

3. The system of claim 2, wherein said means for moving said movable step further comprises:

a) an electric motor being located under said stairway at a lower end thereof adapted to rotate cable spools located at opposite ends of said stairway;

b) a cable for each spool having a first end connected to each said cable spool and a second end of each cable connected to opposite ends of said movable step;

c) pulleys being disposed adjacent to ends of said top step, wherein each said cable travels on a pulley so that said movable step moves from said first to said second position in response to said cable spools being rotated by said motor; and d) a chain and sprocket drive mechanism for connecting said motor to said cable spools to permit the cable spools to turn in response to the motor.

4. The system of claim 3, wherein said means for controlling said movable step comprises an ascension switch for controlling the ascent of said movable step.

5. The system of claim 4, wherein said means for controlling said movable step comprises a descension switch for controlling the descent of said movable step.

6. The system of claim 5, wherein said means for controlling said movable step comprises a pressure sensing switch being disposed on said top surface of said movable step so that said movable step moves only while a user is standing on said movable step.

7. The system of claim 6, wherein said means for controlling said movable step comprises a resistance sensor being disposed on said first and second handrail so that said movable step moves only while a user is grasping said first and second handrail.

8. The system of claim 7, wherein said means for controlling said movable step comprises a step call-up switch so that said movable step can be called-up to said upper level when no user is standing on said movable step or grasping said first and second handrail.

9. The system of claim 8, wherein said means for controlling said movable step comprises a microcontroller for controlling said ascension switch, said descension switch, said pressure sensing switch, said resistance sensor, said call-up switch, sad auto return switch, and said upper and lower stop switches to permit the movable step to be controlled by a user.

* * * * *